United States Patent [19]

Tillmann

[11] 4,349,939

[45] Sep. 21, 1982

[54] AUTOMATIC DOOR CLOSER

[75] Inventor: Horst Tillmann, Ennepetal, Fed. Rep. of Germany

[73] Assignee: Dorma-Baubeschlag GmbH & Co. KG, Ennepetal-Voerde, Fed. Rep. of Germany

[21] Appl. No.: 157,814

[22] Filed: Jun. 9, 1980

[30] Foreign Application Priority Data

Jun. 15, 1979 [DE] Fed. Rep. of Germany ..... 2924311

[51] Int. Cl.[3] ..... E05F 3/10

[52] U.S. Cl. ..... 16/53; 16/58

[58] Field of Search ..... 16/51, 52, 53, 56, 57, 16/58

[56] References Cited

U.S. PATENT DOCUMENTS

| | | | |
|---|---|---|---|
| 3,137,888 | 6/1964 | Blom | 16/51 |
| 3,246,362 | 4/1966 | Jackson | 16/51 |
| 3,584,331 | 6/1971 | D'Hooge | 16/51 X |
| 4,064,589 | 12/1977 | Bejarano et al. | 16/53 |

FOREIGN PATENT DOCUMENTS

| | | | |
|---|---|---|---|
| 2030443 | 12/1971 | Fed. Rep. of Germany . | |
| 2261145 | 6/1974 | Fed. Rep. of Germany | 16/53 |
| 2311918 | 12/1976 | France | 16/58 |
| 425241 | 3/1935 | United Kingdom | 16/53 |

*Primary Examiner*—W. Carter Reynolds
*Attorney, Agent, or Firm*—Michael J. Striker

[57] ABSTRACT

An automatic door closer in which a piston operatively connected to the door to be moved in axial direction during turning of the door in either direction from a closed to an open position divides the fluid filled housing of the door closer into two pressure compartments which are connected by two channels in which adjustable throttles are arranged to dampen the movement of the door or to be completely closed to prevent passage of fluid through the channels to hold the door in any open position.

5 Claims, 3 Drawing Figures

D
II
V
10
11
12
13
14
15
17
22
23
24
25
26
27
28
30
31
32
33
34
35
36
37
38
39
40
41
42
43
44
45
50
53

I
IV
10
11
16
17
19
20
21
25
26
27
28
29
30
31
32
33
34
36
38
40
41
42
43
44
46
47
48
49
51
52
53
54
55

AUTOMATIC DOOR CLOSER

The invention relates to an automatic door closer with a closing shaft, which can be coupled with the wing of a door so that it may be pivoted from a closed position in both directions of rotation, and which, within the housing positively grips with a lift cam disc between the rolls of a longitudinally moveable slide, which is acted upon by a spring arrangement which forms an energy storage and by the piston of a hydraulic damping device, whereby the inner space of the housing of the door closer is divided by the piston into two separate pressure-medium spaces, which can be connected with one another by channels for the differently throttleable discharge of the pressure medium from the pressure space, which becomes smaller as the door closes, and by a safety valve, which is arranged in the piston and which opens up as excess pressure developes during the closing motion of the wing of the door.

In a door closer of the aforementioned type (German Offenlegungsschrift No. 2,030,443), the pressure medium spaces in front of and behind the piston are bridged by channels arranged so as to be offset one behind the other in the longitudinal direction of the door closer. Throttling devices, by means of which the return flow velocity of the pressure medium from the pressure medium space between piston and vent plug of the cylinder into the pressure medium space of the housing holding the spring arrangement can be adjusted, are mounted in the channels. By such means, it is possible to dampen the first phase of the closing motion of the wing of the door in the region where the angle of opening exceeds 75° more than the second phase of the door closing motion in the region where the angle of opening of the wing of the door is less than 75°. The greater retardation of the door-closing motion in the region where the angle of opening of the wing of the door exceeds 75°, is achieved by the tandem connection of the throttling valves. After the door-opening angle falls below 75°, the second throttling valve is short-circuited by the release, by means of the piston, of a channel which circumvents the second throttling valve so that only the throttling of the first valve is effective. Consequently, the closing velocity increases until, at a door-opening angle of ca. 15°, the main supply channel to the first throttling valve is covered by the piston and only a side channel still remains free, through which the pressure medium is supplied to a more strongly throttling pre-throttling section of the first throttling valve. Consequently, during the last portion of the closing motion of the wing of the door, throttling is once again increased. With the known door closer, it is therefore possible to obtain a stepwise closing velocity, which depends on the door opening angle. However, it is not possible to arrest the wing of the door with this known door closer. This would be advantageous particularly in the case of those doors which are often frequented by longer lasting transports, as is the case with buildings which are accessible to a large number of persons. Especially for the passage of bulky objects or of larger groups of persons, even a highly retarded door closing motion is not sufficient for enabling the passage to be unhindered. In addition, the flow of the pressure medium supplied to the throttling valves is controlled by the damping piston itself which is disadvantageous in so far as the sealing ring of the piston passes over the outlets of the channels in the cylinder wall, as a result of which the sealing ring is subjected to additional wear.

It is an object of the invention to provide a door closer of the aforementioned type, in which the possibility exists, by means of blocking the throttling device of the channels, of arresting the leaf of the door in predeterminable regions and of cancelling this arrest by a briefly acting, higher expenditure of energy on the leaf of the door for the purpose of initiating an automatic, adjustable, damped closing motion without having the damping piston itself block or release the channels directly.

This object is accomplished according to the invention in that two throttleable channels, as a result of the action of a blocking element which can be displaced by the piston, alternately can be closed or opened and that, in addition to a separate check valve which in itself is known and which connects the pressure-medium spaces during the opening motion of the wing of the door, a pressure-controlled control valve, which discharges into the pressure space, is connected in at least one throttleable channel. By these means, it is possible to utilize the door closer also as a door arrester because, with the channels closed by the throttling device, the pressure medium cannot flow away from the pressure space between the piston and the threaded plug by the action of the return spring alone if the control valve is so adjusted that the pressure in the pressure space, produced by the return spring, is not sufficient for opening the control valve. Only when the force of the return spring is supported by a brief exertion of a closing force on the wing of the door (e.g. a push) and a pressure of sufficient magnitude is produced in the pressure space so that the control valve opens, can the pressure medium flow from the pressure space in front of the piston into the pressure-medium space holding the closing spring. Through the design of the valve body of the control valve as a stepped piston, the stepped valve seat of the latter is smaller than the cross section of the valve body, so that, once the valve body had been lifted from the valve seat, it remains in its open position. Moreover, by using a blocking element activated by the piston, the cylinder bore in the housing of the door closer can remain free from junctions with the throttling channels, so that, by using sealing sleeves with the piston so as to seal the pressure space from the pressure-medium space, no leaks can develop as a result of the increased wear of the seal between the piston and its cylinder wall. For this reason, both channels discharge, according to a characteristic refinement of the invention, in a central, stepped bore, open to the pressure space, of a threaded plug which closes off the pressure space, a force-loaded, sleeve-shaped, stepped blocking element being arranged in the stepped bore.

So that, on the one hand, the return-flow velocity in the range of door-opening angles from 80° to 180° may be different from that in the range of door-opening angles from 0° to 80° and, on the other, the range of door openings, in which the wing of the door may be arrested, can be selected, the throttleable channels discharge offset to each other in relation to the longitudinal direction of the door closer into the stepped bore of the threaded plug and are separated by a distance, which corresponds to the traverse of the piston for a door-opening angle of 80° and to which the length of the blocking section—of equal diameter—of the control slide valve, which is guided in the stepped bore so as to close it off, is adjusted.

So that the wing of the door can be arrested especially in the range of door-opening angles from 80° to 180° by closing the corresponding throttling valve and can automatically be transferred from the arrested position into its completely closed position by the brief action of an external force on the wing of the door, the control valve is preferably integrated in the channel which discharges the pressure medium in the range of door opening angles from ca. 80° to the closed position. In this case, the throttling valve, connected to the channel corresponding to the range of door-opening angles from 0° to 80°, is opened so that, with an open control valve, a return flow of the pressure medium from the pressure space into the pressure-medium space holding the spring arrangement is possible. At the same time, the force of the spring pressing on the valve body of the control valve is so adjusted, that the closing force of this control valve is less than the closing force of the safety valve mounted in the piston.

In order to be able to open the return-flow channel belonging to the corresponding range of door openings, the blocking element has, according to a further refinement of the invention a control section adjoining its blocking section and the front face of the control section can be acted upon from the base of the piston, which is connected with the slide, during a segment of the traverse of the piston. The reversal operation of the blocking element to close one channel and to open the other preferably takes place at a door opening angle of approximately 80°.

An embodiment according to the invention is represented in the drawing.

Figure 3:
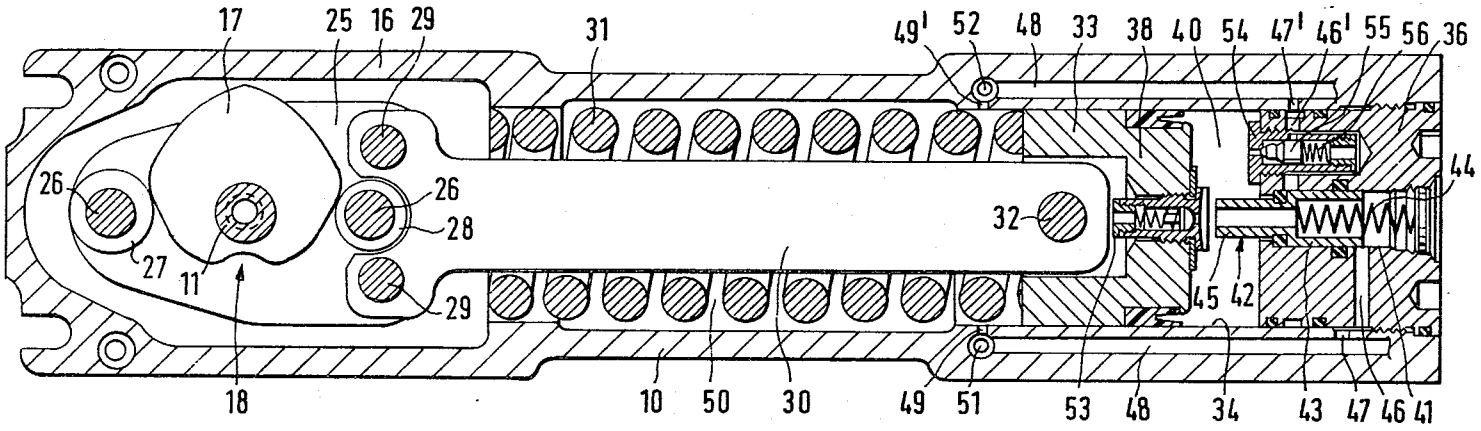
FIG. 3 shows a plan view, corresponding to FIG. 2, in which the closing mechanism however has taken up a position corresponding to a 90° opening of the door.

The floor door closer, on which the embodiment is based, is intended for example for a swinging door and has a housing 10, which is to be filled with a pressure medium, such as oil for example. One end of a closer shaft 11 is mounted in the housing 10 in such a manner that it can rotate. The closer shaft 11 has a noncylindrical socket 12, in which a pin (not shown) of the required length is fixed and with which the door can be connected. The door is shown in part in dash-dot lines in FIG. 1 with the bottom face of the door closely adjacent to the top face of the door closer. The closer shaft 11 is supported rotatably at its upper end by means of a bearing 13 in a ring bearing 14 which can be bolted to the housing 10 and at its lower end by means of a bearing 15 in the housing 10. The closer shaft 11 is sealed in the ring bearing 14 by means of a gasket. Within a head space 16 of the housing, the closer shaft has a lifting cam disc 17. The same comprises two regions, which are symmetrical about a central plane. The cam curve is characterized by a zone 18, which provides for the closed position, and moreover by two gradually rising zones 19 and 20, as well as by a more steeply rising zone 21. Longitudinal regions 22 and 23 of the closer shaft, which are adjacent the cam disc 17 pass through parallel guide slots 24 in plates 25. The guide slots 24 are connected together to form a slide with a clear spacing which exceeds the thickness of the cam disc 17. Two pins 26 are used for the connection, whose end portions engage the plates 25, while their central longitudinal regions respectively rotatably hold rolls 27 and 28. The rolls 27 and 28 interact with the traverse cam plate 17, that the latter lies between them with little play in every conceivable position of rotation. A rod 30 is connected for example by rivets 29 with the slide formed by plates 25. The rod 30 passes through a compression spring 31 which acts as a energy storage. In the free-end region of the rod 30, the compression spring 31 is in contact with a piston 33, which is connected with the rod 30 by means of a gudgeon pin 32 and the piston can be displaced in a cylinder bore 34 of housing 10 so as to seal it. The end of spring 31, facing the closer shaft 11, is in contact with the stop 35 formed in housing 10. At the free end of the housing, the cylinder bore 34 is closed off by a threaded plug 36. In a channel bore 37 in the base 38 of piston 33, a check valve 39 with a spring-loaded closing member is mounted in such a manner, that the channel bore 37 is open when the piston moves to the left and closed when the piston moves to the right. The traverse path of the closing element is limited by stops. Between the threaded plug 36 and the base 38 of piston 33, which faces this plug, there is the pressure space 40 of the damping device, which changes as the door moves. A sleeve-shaped, stepped blocking element 42, which is displaceably mounted in a stepped bore 41 of the threaded plug 36, ends in this pressure space 40. This blocking element has a blocking section 43 of an axial length corresponding to the stroke of the piston 33 when the door moves to an opening angle of about 80°. The blocking section 43 is guided in a leakproof manner in a subsection of the stepped bore 41 of equal diameter and is subjected to a force in the direction of the pressure space 40 by a compression spring 44. The blocking section 43 of the blocking element 42 is adjacent to the control section 45, which passes through the section of the stepped bore 41 having a smaller diameter into the pressure space 40 in such a manner that an annular clearance remains between the stepped bore 41 ending in the pressure space 40 and the control section 45. At the same time, a seal is arranged on the control section in the region of the adjoining blocking section 43. As shown in FIG. 3, this seal seals the annular clearance between the stepped bore 41 and the control section 45 when the blocking element 42 is pushed out. In the rear region of the stepped bore 41, a radial bore 46 is arranged in the threaded plug 36. This radial bore ends in a recess in the housing 10, which corresponds to the outside diameter of the thread of the plug. This recess is connected via a channel section 47 with a channel section 48 running in the longitudinal direction of the housing 10. Channel section 48 ends via a cross bore 49 in the pressure-medium space 50, which holds the compression spring 31. In the transition between the cross bore 49 and the channel section 48, there is arranged a throttling device 51 with which the flow in the channel, formed by the radial bore 46, the channel sections 47 and 48 and the cross bore 49, can be throttled as well as blocked completely. In the front region of the stepped bore 41, approximately where the stepped bore 41 connects with its shoulder, a further radial bore 46', which is offset in the longitudinal direction of the housing 10 with respect to the radial bore 46 for a distance equal to the axial length of the blocking section 43, and which ends in a ring channel of the threaded plug 36, passes through the threaded plug 36. A channel section 47' connects with this ring channel. This channel section 47′ ends in a further channel section 48′, which runs in the longitudinal direction of the housing 10 and is, in turn, connected with a cross bore 49′, which leads into the pressure-medium space 50. In the transition between the channel section 48′ and the cross bore 49′, there is also a throttling device 52 with which the flow in the channel, formed by the radial bore 46′, the channel section 47′ and 58′ and the cross bore 49′ can be throttled or blocked completely. In addition to the check valve 39, a safety valve 53 is mounted in the base 38 of the piston. This safety valve 53 is kept closed by the pressure of a spring and is opened, to allow the pressure medium in the pressure space 40 to flow into the pressure medium space 50, only when the piston 33 is moved towards the right as a result of an increase in pressure in the pressure space 40. In addition, a control valve 54 is connected in the radial bore 46′. This control valve 54 is screwed into the threaded plug 36 perpendicularly to the radial bore 46′ and can connect the radial bore 46′ with the pressure space 40, when the valve body 55 is pressed back against the force of the valve compression spring 56.

Figure 1:
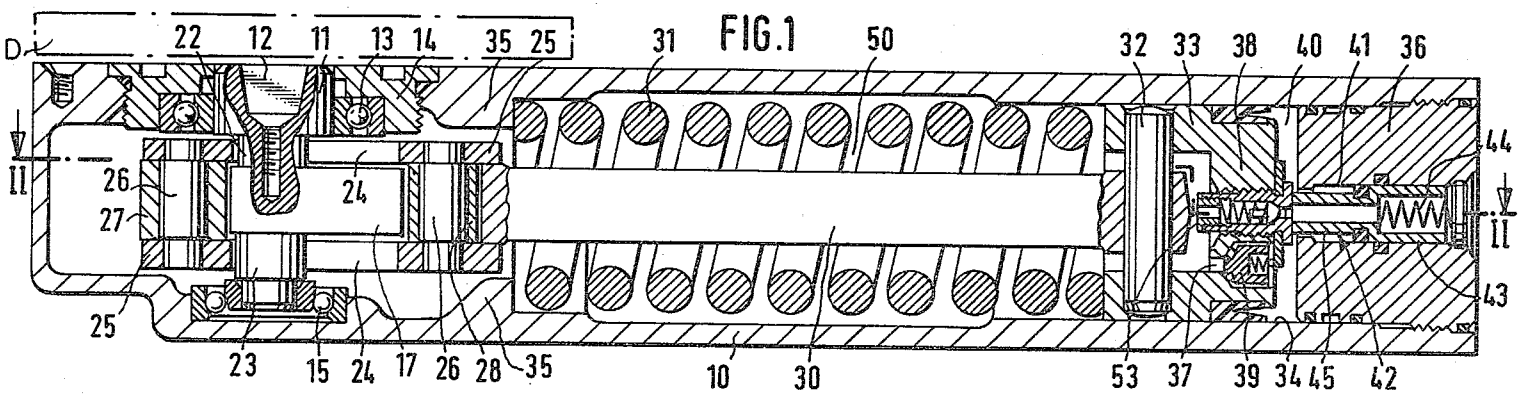
FIG. 1 shows an automatic, floor door closer in a vertical section along the line I—I of FIG. 2 in a position of the closing mechanism corresponding to the closed position of the door.
Figure 2:
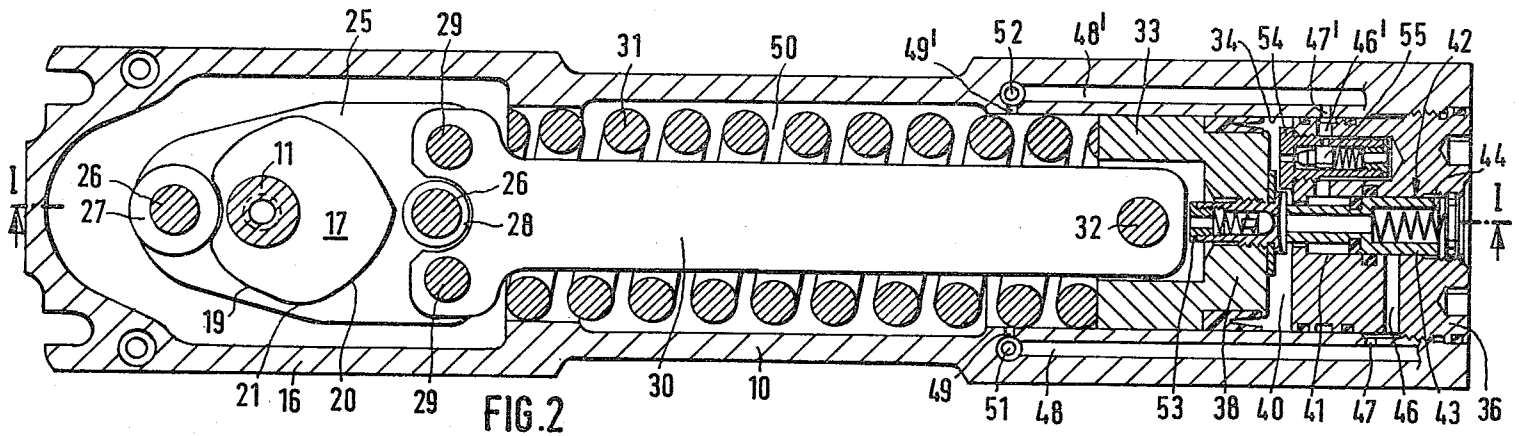
FIG. 2 shows the floor door closer, represented in FIG. 1, in a plan view in section along the line II—II of FIG. 1.

In the initial position, which forms the basis for FIGS. 1 and 2 and corresponds to the closed position of the wing of the door, the slide, which is formed by plates 25, lies with roll 27 against region 18 of the curve of the cam disc 17, in conformity with the initial tension on spring 31. The roll 27 abuts thereby at two points, mutually offset on the circumference of the cam disc 17, so that its position of rotation and therefore the closed position of a swinging door are clearly determined. On opening the door to one side or the other, the cam disc 17 turns relative to roll 27 and, as a result of the slope of the cam curve 19, the slide 25 is displaced towards the left. Thereby spring 31 of piston 33 is compressed further via rod 30. In addition, pressure space 40 becomes larger, while damping fluid flows from the pressure medium space 50 through the channel bore 37 past the check valve 39, which is opening up, into the pressure space 40. Because of the steeper slope of the curve at zone 21 of the cam disc, the torque, which must be applied when the door is open in the region of about 90°, temporarily becomes greater while, as the door is opened further and roll 27 lies against zone 20 of the cam curve, the door once again can be operated with an average torque. In the closed position, compression spring 44 presses the sleeve-shaped blocking element onto the transversely slotted collar of the safety valve 53. When the wing of the door is now opened, the front surface of the control section 45 of the blocking element 42 remains, as a result of the action of the compression spring 44, in abutment with the collar of the safety valve 53, until the opening angle of 80° is reached. Only then does the blocking element 42 not follow the piston 33 any further, because its bearing shoulder, enclosed by a gasket, lies between the blocking section 43 and the control section 45 at the front of the stepped bore 41 of the threaded plug 36. In this position, shown in FIG. 3, the radial bore 46 is released while the radial bore 46′ is blocked. If the throttling devices 51 and 52 are now so adjusted that the pressure medium can flow past the throttle needles, the pressure medium in pressure space 40 will, as the wing of the door is let go, reach the bore of the sleeve-shaped blocking element 42 via the slot in the collar of the safety valve 53 and from there flow back into the pressure-medium space 50 of housing 10 via the channel formed by the radial bore 46, the channel sections 47 and 48 as well as the cross bore 49 and past the throttling device 51. At the same time, the closing velocity can be determined by adjusting the throttling device 51. As a result of the pressure medium flowing from the pressure space 40, the piston 33 is moved towards the right by the compression spring 31, whereby the blocking element 42 is also pushed by the piston 33 towards the right. As a result, blocking section 43 of the blocking element moves over radial bore 46, blocking it. At the same time however, the seal of the blocking element 42, mounted at the bearing shoulder between the blocking section 43 and the control section 45, releases the radial bore 46′, which occurs at a door-opening angle of about 80°. At this opening angle, the pressure medium flows via channels 46′ to 49′ past the throttling device 52 back into the pressure-medium space 50, while channels 46 to 49 remain blocked until the door reaches its totally closed position. By appropriately adjusting the throttling device 52, the closing motion of the wing of the door can be damped more or less also in the range of opening angles between 80° and 0°.

When however both throttling devices 51 and 52 are closed completely, so that the pressure medium in pressure space 40 cannot pass through either of the two channels 46 to 49 or 46′ to 49′, the wing of the door may be arrested in any open position. As described previously, it is possible to open the wing of the door via the cam disc 17, the slide 25, the rod 30 connected to the slide and the piston 33 linked to the rod, by withdrawing the piston 33 against the force of the compression spring 31 and so enlarging the pressure space 40, while at the same time the pressure medium in pressure-medium space 50 of housing 10 can reach the pressure space 40 via the opened check valve 39. If now the wing of the door is let go in any open position, the compression spring 31 acts in a closing sense on piston 33, whereby a pressure is built up in the pressure space 40 and closes the check valve 39. Because throttling devices 51 and 52 are also closed, the pressure medium cannot flow from the pressure space 40 into the pressure-medium space 50 via either of the channels 46 to 49 or 46′ to 49′, depending on the position of the blocking element 42. Consequently, the wing of the door remains in the open position attained. Only when the wing of the door is pushed back into its closed position by the expenditure of force, is an even higher pressure built up in the pressure space 40, as a result of which the safety valve 53 in the base 38 of the piston is opened, so that the pressure medium flows from the pressure space 40 through the safety valve 53 into the pressure space 50 and, by so doing, the door can be closed.

It is however also possible to close only the throttling device 51, whereby the wing of the door can be arrested only in the range of door-opening angles above 80°, because the displaceable blocking element 42 remains in the position shown in FIG. 3 during a door-opening angle greater than 80° and so blocks the radial bore 46′ of channel 46′ to 49′, even when the throttling device 52 is set in an open position corresponding to the desired closing velocity of the door. If now the wing of the door is in an open position at an angle greater than 80°, with throttling device 51 closed and throttling device 52 slightly open, the closing action of this wing of the door may be initiated by exerting a brief, external force in the closing direction in addition to the closing force of the compression spring 31. The slight increase in pressure in pressure space 40 forces the valve body 55 which is constructed as a stepped piston, from its valve seat against the force of the valve compression spring 56, so that the pressure, produced by the compression spring 31, now acts on the whole of the piston surface of the valve body 55, holding it in its open position, and the pressure medium is returned from the pressure space 40 via the control valve 54 into the pressure-medium space 50 by means of the force of the compression spring 31 alone. The compression of the valve compression spring 56 of the control valve 54 moreover is set somewhat lower than that of the spring of the safety valve 53. Consequently, the pressure medium, appropriately damped, reaches the pressure medium space 50 through control valve 54 into the radial bore 46' of channel 46' to 49' and past the open throttling device 52. As already mentioned, the control slide 42 takes up a position shown in FIG. 3, until the collar of the safety valve 53 has reached the front face of control section 45 at the displaceable blocking element 42 and has now pushed this back further, so that the pressure medium can now also reach the radial bore 46' of channel 46' to 49' through the annular clearance between the front region of the stepped bore 41 and the control section 45 of the blocking element 42. The closing motion of the wing of the door then also continues during the last 80° of the door-opening angle, automatically damped, as a result of the action of compression spring 31 alone. In this case however, the wing of the door can be arrested only in the range of door opening angles above 80°. In the range of door-opening angles between 0° and 80°, the wing of the door returns damped to its closed position immediately after being let go.

It is however also possible to close throttling device 52 completely and to open throttling device 51 according to the desired return velocity of the wing of the door. In this latter case, it is possible to arrest the wing of the door only in the range of door-opening angles between 0° and 80° because as the wing of the door is opened beyond 80° and let go, piston 33 is pushed to the right by compression spring 31, while the pressure medium in compression space 40 is pushed back into the pressure medium space through the bore of the blocking element 42 via channel 46 to 49. Only when the piston has pushed the blocking element 42 slightly to the right, so that the radial bore 46 is blocked by the blocking section 43 of the blocking element 42, does the wing of the door remain in the open position of about 80° which it has then reached, because the throttling device 52 in channel 46' to 49' is closed and the pressure medium in pressure space 40 cannot flow away through the radial bore 46', which is then released by the control section 45 of the blocking element 42. In this case, if the wing of the door is to be returned to its closed position, a larger force must be applied to it in the closing direction, so that the safety valve 53 opens up and the pressure medium in pressure space 40 can flow back directly through the safety valve 53 into the pressure-medium space 50.

If however both throttling devices 51 and 52 are open, the wing of the door returns to its closed position from any open position in the usual manner with a damped velocity. At the same time, the throttling devices 51 and 52 may be opened to a different extent, so that the wing of the door can return in two steps at different speeds to its closed position.

As already mentioned, the construction shown is only an example of the realization of the invention and is in no way limited to this. Rather, other constructions and refinements are possible.

It will be understood that each of the elements described above, or two or more together, may also find a useful application in other types of door closers differing from the types described above.

While the invention has been illustrated and described as embodied in an automatic door closer it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an automatic door closer including an elongated housing having opposite closed ends; a closer shaft adapted to be connected to a door mounted in the region of one end of said housing turnable from a position in which the door is closed in either direction; a cam disc fixed to the closer shaft for turning therewith; a slide carrying a pair of rollers for cooperation with said cam disc for moving the slide in longitudinal direction of said housing during the turning of the closer shaft and the cam disc; a rod extending in longitudinal direction of said housing fixed at one end to said slide; a piston fixed to the other end of the rod and movable in a cylinder bore of said housing and dividing the interior of the latter into two pressure spaces; a compression spring surrounding said rod and abutting with opposite ends respectively against said piston and a stop formed in the housing to urge said piston toward the other closed end of said housing so as to reduce the volume of the one pressure space which is located between said piston and said other end of said housing and to move said slide to a position in which the rollers thereof cooperate with said cam disc to move the door connected to said closer shaft to the closed position; overpressure valve means in said piston constructed to open by the overpressure in said one pressure space during reduction of the volume thereof during the closing movement of the door, the improvement comprising a pair of channel means for connecting the pressure spaces to each other; blocking means in said other closed end of said housing movable by said piston to alternatingly open and close said channel means; one-way valve means in said piston constructed to open during movement of said piston in door opening direction; and control valve means in at least one of said channel means movable to a position permitting flow of fluid through said one channel means upon increase of pressure in said one pressure space; and adjustable throttle means in each of said channel means constructed to throttle the flow of fluid from said one to the other pressure space or completely stop such flow.

2. An automatic door closer as defined in claim 1, wherein said other end of said housing is closed by a plug, a stepped bore formed in said plug having an open end communicating with said one pressure space and an opposite closed end, each of said channel means communicating at one of its end with said stepped bore and wherein said blocking means comprises a sleeve shaped stepped blocking member and spring means biasing said blocking member towards said piston.

3. An automatic door closer as defined in claim 2, wherein said one end of one of said channel means is offset in the longitudinal direction of said housing toward the one housing end with respect to the one end of the other channel means for a distance corresponding to the stroke of said piston when the door moves to an opening angle of about 80°, said blocking member having a large diameter portion of a diameter equal to a large diameter portion of the stepped bore and of an axial length equal to said distance.

4. An automatic door closer as defined in claim 3, wherein said control valve means is integrated in said one channel means, fluid flows through said one channel means from the one to the other pressure space when the door moves from an about 80° open position to the closed position.

5. An automatic door closer as defined in claim 3, wherein said blocking member comprises a small diameter portion projecting from said large diameter portion toward said piston and said small diameter portion has an end face to be engaged by said piston during part of the movement of the latter so as to move said blocking member against the force of said spring means.

* * * * *